US005622806A

United States Patent [19]

Veregin et al.

[11] Patent Number: 5,622,806

[45] Date of Patent: Apr. 22, 1997

[54] TONER AGGREGATION PROCESSES

[75] Inventors: Richard P. N. Veregin, Mississauga; Maria N. V. McDougall, Burlington, both of Canada

[73] Assignee: Xerox Corporation, Stamford, Conn.

[21] Appl. No.: 576,246

[22] Filed: Dec. 21, 1995

[51] Int. Cl.[6] ..... G03G 9/087; G03G 9/093

[52] U.S. Cl. ..... 430/137; 430/110

[58] Field of Search ..... 430/137

[56] References Cited

U.S. PATENT DOCUMENTS

| | | | |
|---|---|---|---|
| 3,900,588 | 8/1975 | Fisher . | |
| 3,983,045 | 9/1976 | Jugle et al. . | |
| 4,996,127 | 2/1991 | Hasegawa et al. | 430/109 |
| 5,366,841 | 11/1994 | Patel et al. | 430/137 |
| 5,403,693 | 4/1995 | Patel et al. | 430/137 |
| 5,405,728 | 4/1995 | Hopper et al. | 430/137 |
| 5,482,812 | 1/1996 | Hopper et al. | 430/137 |
| 5,496,676 | 3/1996 | Croucher et al. | 430/137 |

*Primary Examiner*—Roland Martin
*Attorney, Agent, or Firm*—E. O. Palazzo

[57] ABSTRACT

A process for the preparation of toner compositions with controlled particle size comprising:

(i) preparing a pigment dispersion in water, which dispersion is comprised of a pigment, an ionic surfactant in amounts of from about 0.5 to about 10 percent by weight to water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent;

(iii) stirring the resulting sheared viscous mixture of (ii) at from about 300 to about 1,000 revolutions per minute to form electrostatically bound substantially stable toiler size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (v);

(v) heating and coalescing from about 5° to about 50° C. above about the resin glass transition temperature, Tg, which resin Tg is from between about 45° C. to about 90° C., the statically bound aggregated particles to form said toner composition comprised of resin, pigment and optional charge control agent;

(vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent driving of the particles at a temperature of from about 15° C. to about 5° C. below the glass transition temperature of the resin; and (vii) subsequently adding to said toner product a first layer of a hydrophilic oxide, and a second layer of a hydrophobic oxide.

25 Claims, No Drawings

TONER AGGREGATION PROCESSES

BACKGROUND OF THE INVENTION

The present invention is generally directed to toner compositions and processes thereof, and more specifically, to in situ chemical toners wherein there is added to the surface thereof a first layer of metal oxide particles, preferably hydrophilic metal oxide particles, and which particles are substantially buried, or incorporated into the toner surface; and subsequently there is added a second layer thereover of metal oxide particles, wherein the second layer is preferably comprised of hydrophilic metal oxide particles or hydrophobic metal oxide particles, and which second layer particles are dispersed onto the toner surface and over the buried first metal oxide layer. The aforementioned metal oxide particles are available from a number of sources, such as Degussa Chemicals, and the first and second metal oxide particles are present as separate layers on the toner surface. The toners of the present invention can be prepared by chemical methods as indicated herein, and thereafter the first and second metal oxide surface layer additives are included by a two step blending method. With the toners of the present invention there results in embodiments excellent admix characteristics, for example the admix thereof is from about 30 seconds to about 60 seconds. The toner compositions without the additives are prepared by in situ methods, without the utilization of the known pulverization and/or classification methods, and wherein toners with an average volume diameter of from about 1 to about 25, and preferably from 1 to about 10 microns, and narrow GSD can be obtained; followed by the addition of the first metal oxide layer, and then the addition of the second metal oxide layer by, for example, known mixing methods. The resulting toners with the two metal oxide surface additive layers can be selected for known electrophotographic imaging and printing processes, including color processes, and lithography. In embodiments, the present invention is directed to a process comprised of dispersing a pigment and optionally a charge control agent or additive in an aqueous mixture containing an ionic surfactant in an amount of from about 0.5 percent to about 10 percent and shearing this mixture with a latex mixture comprised of suspended resin particles of from about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in an amount of from 0 percent to about 5 percent, thereby causing a flocculation of resin particles, pigment particles and optional charge control particles, followed by stirring of the flocculent mixture, which is believed to form statically bound aggregates of from about 1 micron to about 10 microns, comprised of resin, pigment and optionally charge control particles, and thereafter, adding extra anionic or nonionic surfactant solution with a concentration of from about 5 percent to about 30 percent in the controlled amount, which will result in the overall final concentration of this surfactant in the aggregated mixture of from about 0.5 percent to about 10 percent, and preferably from 1 percent to 5 percent (weight percent throughout unless otherwise indicated) to thereby enable any further growth in particle size and GSD during the heating step, which size in embodiments is from about 3 to about 10 microns in average volume diameter, and with a GSD of from about 1.16 to about 1.26; and then heating the mixture above the polymeric resin Tg, which Tg is in range of from between about 45° C. to about 90° C. and preferably between about 50° C. and 80° C., and more preferably the resin Tg is equal to 54° C., to generate toner with an average particle volume diameter of from about 1 to about 10 microns, and wherein the stirring speed in (iii) is reduced from about 300 to about 1,000 to about 100, preferably 150, to about 600 rpm, primarily to substantially eliminate fines of about 1 micron in average volume diameter, which fines can adversely affect toner yield. It is believed that during the heating stage, the components of aggregated particles fuse together to form composite toner particles. Subsequently, there is added in one step to the resulting toner a hydrophobic metal oxide layer and by a second step a top layer of a hydrophilic metal oxide.

In embodiments thereof, the present invention is directed to an in situ process comprised of first dispersing a pigment, such as HELIOGEN BLUE™ or HOSTAPERM PINK™, in an aqueous mixture containing a cationic surfactant, such as benzalkonium chloride (SANIZOL B-50™), utilizing a high shearing device, such as a Brinkmann Polytron, or microfluidizer or sonicator, thereafter shearing this mixture with a charged latex of suspended resin particles, such as poly(styrene/butadiene/acrylic acid) or poly(styrene/butylacrylate/acrylic acid) or PLIOTONE™ of poly(styrene butadiene), and of particle size ranging from about 0.01 to about 0.5 micron as measured by the Brookhaven nanosizer in an aqueous surfactant mixture containing an anionic surfactant, such as sodium dodecylbenzene sulfonate (for example NEOGEN R™ or NEOGEN SC™) and nonionic surfactant, such as alkyl phenoxy poly(ethylenoxy) ethanol (for example IGEPAL 897™ or ANTAROX 897™), thereby resulting in a flocculation, or heterocoagulation of the resin particles with the pigment particles; and which on further stirring for from about 1 hour to about 24 hours with optional heating at from about 5° to about 25° C. below the resin Tg, which Tg is in the range of between 45° to 90° C. and preferably between about 50 and 80° C., results in formation of statically bound aggregates ranging in size of from about 0.5 micron to about 10 microns in average diameter size as measured by the Coulter Counter (Microsizer II); and adding concentrated (from about 5 percent to about 30 percent) aqueous surfactant solution containing an anionic surfactant, such as sodium dodecylbenzene sulfonate (for example NEOGEN R™ or NEOGEN SC™) or nonionic surfactant, such as alkyl phenoxy poly(ethylenoxy) ethanol (for example IGEPAL 897™ or ANTAROX 897™), in controlled amounts to prevent any changes in particle size, which can range from 3 to 10 microns in average volume diameter and a GSD which can range from about 1.16 to about 1.28 during the heating step, and thereafter, heating to 10 to 50° C. above the resin Tg to provide for particle fusion or coalescence of the polymer and pigment particles; followed by washing with, for example, hot water to remove surfactants, and drying whereby toner particles comprised of resin and pigment with various particle size diameters can be obtained, such as from 1 to 12 microns in average volume particle diameter, and wherein the stirring speed in (iii) is reduced in (iv) as illustrated herein. Subsequently, there is added in one step to the resulting toner a layer of hydrophilic metal oxide, wherein the layer of metal oxide is substantially buried into the toner surface, and thereafter, a second metal oxide layer is added, and which second layer is comprised of a hydrophobic metal oxide, and wherein the second metal oxide layer is dispersed onto the toner surface on top of the buried first metal oxide layer. The aforementioned toners are especially useful for the development of colored images with excellent line and solid resolution, and wherein substantially no background deposits are present. While it is not desired to be limited by theory, it is believed that the toner particles undergo plastic flow, as a result of the combination of mechanical stress and localized heating, causing the metal oxide layer to be substantially buried. The ability of the toner particles to undergo plastic flow, and thus to allow the additive layer to be buried depends, for example, on the mixing time, the mixing temperature, and on the intensity of mixing, which is controlled with a combination of agitation type, agitation rate, agitation force, and the optional addition of milling material, such as metal, plastic, or ceramic beads, and the like, such that the metal oxide layer is buried, but such that the temperature of the toner particles remains at least 5° C., and preferably more than 10° C. below the toner Tg so that agglomeration of the toner particles is substantially avoided. Thereafter, a second metal oxide layer is added, and which second layer is comprised of a hydrophobic metal oxide, or a hydrophilic metal oxide, and wherein the second metal oxide layer is dispersed onto the toner surface on top of the buried first metal oxide layer. By reducing the blending time, the blending temperature, and optionally reducing the blending intensity, the second additive layer is not substantially buried into the toner surface. While it is not desired to be limited by theory, it is believed that in the second step, that the toner particles do not undergo sufficient plastic flow, as a result of the combination of mechanical stress and localized heating, preventing any substantial amount of metal oxide from being buried into the toner surface. The intensity of mixing is reduced with a combination of reduced agitation rate, reduced agitation force, changing the agitation type, removing or reducing the amount of optional milling material, or the milling material, such as metal, plastic, or ceramic beads, and the like, such that the metal oxide layer is not substantially buried. In addition, it is important that the temperature of the toner particles remains at least 5° C. below the toner Tg, and preferably more than 10° C. below the toner Tg, so that agglomeration of the toner particles, and burying of the additive is substantially avoided.

Toners with fumed silica surface additives are known, reference for example U.S. Pat. No. 3,900,588, the disclosure of which is totally incorporated herein by reference. Additionally, there are illustrated in U.S. Pat. No. 3,983,045 developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43. Toners with silica like AEROSIL® are also known.

There is illustrated in U.S. Pat. No. 4,996,127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of acrylic acid polar group, see Comparative Example I. In U.S. Pat. No. 4,983,488, there is illustrated a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of opposite charges are selected.

Illustrated in copending patent applications U.S. Ser. No. 331,444 and U.S. Ser. No. 331,441, now U.S. Pat. Nos. 5,486,443 and 5,482,805, respectively, the disclosures of which are totally incorporated herein by reference, are toners with surface additive mixtures of silica, polyvinylidene fluoride, a KYNAR®, and strontium titanate.

The toner compositions of the present invention, prior to the addition of metal oxide layers, are preferably prepared by chemical methods, and more specifically, by emulsion/aggregation methods as illustrated in U.S. Pat. Nos. 5,418,108; 5,370,963; 5,344,738; 5,403,693; 5,364,729 and 5,405,728, the disclosures of which are totally incorporated herein by reference. In U.S. Pat. No. 5,370,963, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,364,797, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

SUMMARY OF THE INVENTION

Examples of objects of the present invention include:

It is an object of the present invention to provide toner compositions and processes thereof with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture containing pigment particles, and optional charge control agents, and other known optional additives dispersed in water containing a cationic surfactant by shearing, microfluidizing or ultrasonifying; (ii) shearing the pigment mixture with a charged, positively or negatively, latex mixture comprised of a polymer resin, anionic surfactant and nonionic surfactant thereby causing a flocculation or heterocoagulation; (iii) stirring with optional heating at about 5° C. to 25° C. below the resin Tg, which resin Tg is in the range of about 45° C. to about 90° C. and preferably between 50° C. and 80° C., allows the formation of electrostatically stable aggregates of from about 0.5 to about 5 microns in volume diameter as measured by the Coulter Counter; (iv) reducing the stirring speed and then adding additional anionic or nonionic surfactant into aggregates to increase their stability and to retain particle size and particle size distribution during the heating stage; and (v) coalescing or fusing the aggregate particle mixture by heat to toner composites, or a toner composition comprised of resin, pigment, and charge additive.

In a further object of the present invention there is provided a process for the preparation of toner with an average particle diameter of from between about 1 to about 50 microns, and preferably from about 1 to about 7 microns, and with a narrow GSD of from about 1.2 to about 1.3 and preferably from about 1.16 to about 1.25 as measured by the Coulter Counter.

Moreover, in a further object of the present invention there are provided toner compositions with improved admix characteristics.

In another object of the present invention there are provided toners prepared by emulsion/aggregation methods, followed by the addition to the surface thereof of two separate layers, a hydrophilic metal oxide layer substantially buried into the toner surface; and in contact with the toner surface, and a second metal oxide layer, wherein the metal oxide is hydrophobic or hydrophilic, and wherein the second layer is dispersed onto the toner surface on top of the buried metal oxide layer. In the preferred composition, the first metal oxide layer is comprised of hydrophilic metal oxide particles, and the second metal oxide layer is comprised of a hydrophobic metal oxide. Examples of the first metal oxide include silicon dioxides, titanium dioxides, aluminum oxides, magnetites, and the like, while examples of the second metal oxide include hydrophobic oxides, such as treated silicon dioxides, iron oxides, magnetites, and the like. Treatment can be with silanes, waxes, oils, polymers, silicones, hydrocarbons, and the like.

Another object of the present invention resides in processes for the preparation of small sized toner particles with narrow GSDs, and excellent pigment dispersion by the aggregation of latex particles with pigment particles dispersed in water and surfactant, and wherein the aggregated particles of toner size can then be caused to coalesce by, for example, heating. In embodiments, factors of importance with respect to controlling particle size and GSD include the concentration of the surfactant in the latex, concentration of the counterionic surfactant used for flocculation, the temperature of aggregation, the solids, which solids are comprised of resin, pigment, and optional toner additives content, reduction in stirring speeds, the time, and the amount of the surfactant used for "freezing" the particle size, for example an aggregation of a cyan pigmented toner particle was performed at a temperature of 45° C. for 2.5 hours while being stirred at 650 rpm. The stirring speed can be reduced from 650 to 250 rpm, and then 45 milliliters of 20 percent anionic surfactant can be added, and the kettle temperature raised to 85° C. and held there for 4 hours to coalesce the aggregates to form the toner composite comprised of resin, pigment and optional charge additive. A toner particle size of 4.7 microns and GSD of 1.20, for example, were obtained. Thereafter, there is added to the toner surface the two metal oxide layers indicated herein.

Moreover, in another object of the present invention there is provided a two step blending process for the in situ formation of toners with surface additives therein in two separate layers to enable toners with small particle diameters, excellent GSDs, improved admix characteristics, the separation of admix and charging functions, and the like, and wherein in embodiments the first layer is comprised of a silica with a high silanol density, and the second additive layer is comprised of a silica with a low or high silanol density.

These and other objects of the present invention are accomplished in embodiments by the provision of toners and processes thereof. In embodiments of the present invention, there are provided toners obtained by emulsion/aggregation methods, followed by adding thereto a first hydrophilic metal oxide layer; and subsequently a second layer thereover of hydrophobic metal oxide particles.

Embodiments of the present invention include a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii);

(v) heating and coalescing from about 5 to about 50° C. above about the resin glass transition temperature, Tg, which resin Tg is from between about 45° C. to about 90° C. and preferably from between about 50° C. and about 80° C., the statically bound aggregated particles to form said toner composition comprised of resin, pigment and optional charge control agent;

(vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent drying of the particles at a temperature of from about 15° C. to about 5° C. below the glass transition temperature of the resin; and (vii) subsequently adding to said toner product a first layer of a hydrophilic metal oxide, and a second layer of a hydrophobic metal oxide; and wherein the thickness of the first layer of a hydrophilic metal oxide is from about 10 nanometers to about 200 nanometers, whereby the metal oxide occupies about 10 percent to about 80 percent of the volume of said layer, and the thickness of the second layer of a metal oxide is from about 10 nanometers to about 200 nanometers, whereby the metal oxide covers about 20 percent to about 100 percent of the area of the toner surface; and a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii);

(v) heating and coalescing from about 5 to about 50° C. above about the resin glass transition temperature, Tg, which resin Tg is from between about 45° C. to about 90° C., the statically bound aggregated particles to form said toner composition comprised of resin, pigment and optional charge control agent;

(vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent drying of the particles at a temperature of from about 15° C. to about 5° C. below the glass transition temperature of the resin; and (vii) subsequently adding to said toner product a first layer of a hydrophilic oxide, and a second layer of a hydrophobic oxide.

Examples of oxides that may be selected for the first layer and the second layer, include hydrophilic silicas, including for example, Degussa AEROSIL OX50®, Degussa AEROSIL 90®, Degussa AEROSIL 130®, Degussa AEROSIL 150®, Degussa AEROSIL 200®, Degussa AEROSIL 300®, Degussa AEROSIL 380®, Degussa AEROSIL R972®, Degussa AEROSIL R974®, Degussa AEROSIL R202®, Degussa AEROSIL R805®, Degussa AEROSIL R812®, Degussa AEROSIL R812S®, Wacker S13®, Wacker V15®, Wacker N20®, Wacker T30®, Wacker T40®, Wacker H15®, Wacker H20®, Wacker H30®, Wacker H2000®, Wacker 3004®, Wacker H2015EP®, Wacker H2050EP®, Cabosil TS-530®; and Degussa hydrophilic titania, for example, Degussa P25®and Degussa T805®; hydrophobic alumina, for example, Degussa C604®; and hydrophilic alumina, for example, Degussa Aluminum Oxide C®. These oxides may be utilized in amounts that range from about 0.1 weight percent of metal oxide to toner to 3 weight percent of metal oxide to toner, and preferably between about 0.2 and 2 weight percent. While it is preferable to utilize a hydrophilic metal oxide in the first layer, some hydrophobic treatments of metal render the metal oxide surface hydrophobic, but do not react substantially with the surface hydroxyl groups of the metal oxide. In these situations, there is substantially no chemical bonding of the hydrophobic treatment to the surface hydroxyl groups of the metal oxide. The hydrophobic treatment forms a layer on the hydroxyl groups of the metal oxide, but does not substantially react with the hydroxyl groups. This lack of reaction can be observed, for example, by infrared spectroscopy of the hydrophobic treated metal oxide. These oxides, which include Degussa AEROSIL R202® and Degussa AEROSIL R805®, for example, are also suitable for use in the first metal oxide layer. While it is not desirable to be limited by theory, it is believed that the first metal oxide layer must contain unreacted hydroxyl groups.

The first metal oxide layer is prepared so as to form a layer wherein the metal oxide is substantially buried into the toner surface, such that substantially all of the metal oxide particles are within a layer that has a thickness of about one to two times the diameter of the metal oxide particles, which diameter can be from about 5 to about 100 nanometers, and where the top of the oxide layer is contiguous with the surface of the toner particles. The first metal oxide layer can be observed by cross-section using a transmission electron microscope (TEM), and is substantially invisible on observation of the toner surface using a scanning electron microscope. The metal oxide particles may be applied to the toner surface with any of the blending techniques that are known in the art that have sufficient blending intensity to obtain the aforementioned properties, including use of roll milling with steel shot, plastic beads, or ceramic beads, a paint shaker, a powder mill, Lodige blender, Henschel blender, or Nara hybridizer. For example, such a toner layer can be obtained by roll milling 10 grams of toner in a 120 milliliter bottle with the first layer metal oxide particles and 100 grams of steel shot for 5 hours.

The second metal oxide layer is prepared so as to form a layer that is dispersed on top of the toner surface, on top of the first metal oxide layer that is blended into the surface.

The second metal oxide layer can be obtained by any of the procedures utilized for the first metal oxide layer providing, for example, that the blending intensity can be reduced sufficiently, or the amount of time for the blending is reduced sufficiently so that a toner layer can be obtained. Provided the intensity and time of the blending can be adjusted, for example from 5 seconds to about 12 hours, then the second metal oxide will not be substantially buried into the toner, and will thus not mix with the first toner layer.

Illustrative examples of resin particles include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); terpolymers such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexylene-terephthalate, polyheptylene-terephthalate, polyoctylene-terephthalate, POLYLITE™ (Reichhold Chemical Inc), a polyester resin, PLASTHALL™ (Hall C. P. Company) a polyester, CYGLAS™, (American Cyanamid Company) a polyester molding compound, ARMCO™ (Armco Composites), a polyester, CELANEX™ (Celanese Corporation) a glass reinforced thermoplastic polyester, RYNITE™ (DuPont) a thermoplastic polyester, STYPOL™, a polyester with styrene monomer (Freeman Chemical Corporation), and the like. The resin selected generally can be in embodiments styrene acrylates, styrene butadienes, styrene methacrylates, or polyesters, are present in various effective amounts, such as from about 85 weight percent to about 98 weight percent of the toner, and can be of small average particle size such as from about 0.01 micron to about 1 micron in average volume diameter as measured by the Brookhaven nanosize particle analyzer. Other known thermoplastic resin polymers may be selected in embodiments of the present invention.

Various known colorants or pigments present in the toner in an effective amount of, for example, from about 1 to about 25 percent by weight of the toner, and preferably in an amount of from about 1 to about 15 weight percent that can be selected include carbon black like REGAL 330®, REGAL 330R®, REGAL 660®, REGAL 660R®, REGAL 400®, REGAL 400R®, and other equivalent black pigments. As colored pigments, there can be selected known cyan, magenta, blue, red, green, brown, yellow, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAperm YELLOW FGL™, HOSTAPERM PINK E™ from Hoechst, CINQUASIA MAGENTA™ available from E.I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments or dyes selected are present in various effective amounts, such as from about 1 weight percent to about 65 weight and preferably from about 2 to about 12 percent of the toner.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum complexes, and the like.

Surfactants in amounts of, for example, 0.1 to about 25 weight percent in embodiments include, for example, nonionic surfactants such as dialkyphenoxypoly(ethyleneoxy) ethanol such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and the like. An effective concentration of the nonionic surfactant is, for example, from about 0.01 to about 10 percent by weight, and preferably from about 0.1 to about 5 percent by weight of monomers used to prepare the copolymer resin.

Examples of ionic include anionic and cationic, and examples of anionic include surfactants selected for the preparation of toners and the processes of the present invention are, for example, sodium dodecyl sulfate (SDS), sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ available from Kao, and the like. An effective concentration of the anionic surfactant generally employed is, for example, from about 0.01 to about 10 percent by weight, and preferably from about 0.1 to about 5 percent by weight.

Examples of the cationic surfactants selected for the toners and processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzaikonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably the molar ratio of the cationic surfactant used for flocculation to the anionic surfactant used in the latex preparation is in the range of about 0.5 to about 4, and preferably from about 0.5 to about 2.

Examples of the surfactant which are added to the aggregated particles to "freeze" or retain particle size, and GSD achieved in the aggregation can be selected from the anionic surfactants, such as sodium dodecylbenzene sulfonate, sodium dodecylnaphthalene sulfate, dialkyl benzenealkyl, sulfates and sulfonates available from Aldrich, NEOGEN R™, NEOGEN SC™ from Kao, and the like. These surfactants also include nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol (available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

An effective concentration of the anionic or nonionic surfactant generally employed in embodiments as a "freezing agent" or stabilizing agent is, for example, from about 0.01 to about 30 percent by weight, and preferably from about 0.5 to about 5 percent by weight of the total weight of the aggregated mixture.

Stirring speeds in (iii) are from about 300 to about 1,000 rpm, and this speed is reduced in (iv) as illustrated herein.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Latent images can then be developed with the aforementioned toner, reference for example U.S. Pat. No. 4,265,690, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated. Comparative Examples are also provided.

EXAMPLE I

Pigment dispersion: 380 grams of Sun Chemicals SUNSPERSE BLUE BHD-6000™ pigment and 120 grams of cationic surfactant alkylbenzyldimethyl ammonium chloride (SANIZOL B-50™) were dispersed in 12 kilograms of deionized water.

A polymeric latex was prepared by emulsion polymerization of styrene/butylacrylate/acrylic acid, 82/18/2 parts (by weight) in nonionic/anionic surfactant solution (3 percent) as follows. 135 Grams of sodium dodecyl benzene sulfonate anionic surfactant (NEOGEN R™ which contains 60 percent of active component), 129 grams of polyoxyethylene nonyl phenyl ether—nonionic surfactant (ANTAROX 897™—70 percent active) were mixed with 8 kilograms of deionized water. To this was added a solution of 60 grams of ammonium persulfate initiator dissolved in 1 kilogram of deionized water. Separately, a mixture of 4,920 grams of styrene, 1,080 grams of butyl acrylate and 120 grams of acrylic acid, and two chain transfer agents, 60 grams of carbon tetrabromide and 210 grams of dodecanethiol, were prepared, and then mixed into the aqueous mixture of surfactants forming an emulsion. The emulsion was then polymerized by ramping the temperature from 25° C. to 70° C. at 1° C./minute, and then maintaining a temperature of 70° C. for 360 minutes.

PREPARATION OF TONER SIZE PARTICLES:

Preparation of the aggregated particles: to 20 kilograms of deionized water, all of the above prepared pigment dispersion was added simultaneously with 13 kilograms of the above prepared latex with continuous agitation at 200 rpm. The pigment dispersion and the latex were well mixed by continuous pumping through a shearing chamber operating at 10,000 rpm for 15 minutes. The shearing was then turned off, and the agitator speed was increased to 350 rpm. The temperature of the mixture was raised from room temperature to 50° C. and the aggregation was performed for 2.5 hours at 50° C.

Coalescence of aggregated particles: The agitator was further slowed to 100 rpm, and a "freezing" solution consisting of 4,247 grams NEOGEN R™ solution (707 grams of NEOGEN R™ in 3,540 grams of deionized water) was added to the aggregated particles. The temperature of the aggregated particles in the kettle was then raised to 93° C. for an additional 4 hours to coalesce the aggregated particles.

The resulting toner was comprised of 95 percent of polystyrene (82 parts), polybutylacrylate (18 parts), polyacrylic acid (2 parts) and cyan pigment, 5 percent by weight of toner with an average volume diameter of 6.1 microns. The toner particles were then washed by filtration using hot water (50° C.) and dried on the freeze dryer. The yield of dry toner particles was 98 percent.

EXAMPLE II

To 10 grams of the toner of Example I were added 35 milligrams of a first metal oxide layer of hydrophobic silica, Degussa AEROSIL R812™, in a 120 milliliter bottle. The resulting toner mixture was then roll milled with 100 grams of steel shot for 35 minutes at 96 feet/minute to blend the silica particles onto the surface of the toner particles. Scanning electron microscopy observation indicated that the silica particles were well dispersed onto the toner particle surface, and were clearly visible on the toner surface. The amount of silica used corresponded to approximately 50 percent of a monolayer coverage, according to a simple calculation, well known in the art, of the area covered by packing spherical silica particles on the surface of a theoretical smooth spherical toner where the silica was assumed to disperse substantially perfectly on the surface. A 50 percent coverage of metal oxide additive was typically used as a reasonable level of additives to utilize in modifying the toner charge or flow properties. It was preferable to utilize the least amount of additive to obtain the properties desired, as increasing the amount of additive will increase the cost, and may increase the probability of unattached additive particles, which can then transfer to other subsystems in the electrophotographic device. Roll milling the aforementioned toner further with the steel shot, wherein the total time of blending of the additive was 5 hours, substantially buried the additive into the surface of the toner. Scanning electron microscopy evidenced that on the order of less than 10 percent of the added metal oxide additive was fully or partially visible on top of the toner surface. Transmission electron microscopy of a cross-section of the toner evidenced that the additive was substantially buried into a layer that was just below the surface of the toner particle. Roll milling the obtained toner with steel shot and with the addition of 35 milligrams of a second metal oxide layer of hydrophilic silica, Degussa A200™ was accomplished, and the additional A200™ additive mixture was blended for 35 minutes, dispersing the A200™, and forming a second additive layer on the surface of the toner, on top of the AEROSIL R812™ layer that was buried into the toner surface by the 5 hours and 35 minutes of total blending time. Scanning electron microscopy observation showed the A200™ silica particles were well dispersed onto the toner particle surface, and were clearly visible on the toner surface.

COMPARATIVE EXAMPLE III

In a 120 milliliter glass bottle, 1 gram of the toner of Example I, but without metal oxide additive layers, was added to 24 grams of carrier particles comprised of a 90 micron steel particle coated with a mixture of 20 percent by weight of VULCAN™ carbon black and 80 weight percent of polymethylmethacrylate; coating weight was 0.175 percent. The toner and carrier were left in an environmental chamber at 20 percent relative humidity overnight. The bottle was then sealed, and the toner and carrier particles were mixed by roll milling for 30 minutes to obtain a stable triboelectric charge. The toner charge was measured using the standard tribo blow-off apparatus. To the now charged developer a further 1 gram of the above uncharged toner, which had also been retained at 20 percent relative humidity overnight, about 20 hours, was added. The toner was then roll milled for increasing intervals from 15 seconds to 15 minutes until it was observed using a standard charge spectrograph apparatus that all of the added toner that was initially uncharged had achieved substantially the same charge as the toner particles that initially had been charged for 30 minutes. The time required for the added to toner to reach the same charge as the rest of the toner was considered as the admix time. This toner did not satisfy this requirement even after 15 minutes of additional roll mill time. The admix time was thus greater than 15 minutes. This admix time was not acceptable for most electrophotographic applications due to the very long time required for added toner to reach the charge of already charged toner. The charge and admix of this toner are tabulated in Table 1.

COMPARATIVE EXAMPLE IV

To 10 grams of the toner of Example I without the two additive layers were added 46 milligrams of hydrophobic silica, Degussa AEROSIL R812™, in a 120 milliliter bottle. The toner was roll milled with 100 grams of steel shot for 35 minutes at 96 feet/minute to disperse the silica particles onto the surface of the toner particle. The amount of silica used corresponded to approximately 50 percent of a monolayer coverage. The toner charge and admix were determined by substantially the equivalent procedure of Comparative Example III, and the results are tabulated in Table 1. The admix time for this toner was within 4 minutes. This admix time was not acceptable for most electrophotographic applications due to the long time required for added toner to reach the charge of already charged toner.

COMPARATIVE EXAMPLE V

To 10 grams of the toner of Example I without the two additive layers were added 23 milligrams of hydrophobic silica, Degussa AEROSIL R812™, in a 120 milliliter bottle. The amount of silica used corresponded to approximately 25 percent of a monolayer coverage. To this mixture was added 47 milligrams of hydrophobic silica, Degussa AEROSIL R202™ Although this metal oxide was hydrophobic, the hydrophobic treatment of this silica did not substantially react with the silica hydroxyl groups. The amount of silica used corresponds to approximately 50 percent of a monolayer coverage. The total amount of silica used corresponded to approximately 50 percent of a monolayer coverage. The toner was roll milled with 100 grams of steel shot for 35 minutes at 96 feet/minute to disperse the silica particles onto the surface of the toner. The toner charge and admix were determined by the same procedure of Comparative Example III, and the results are tabulated in Table 1. The admix time for this toner was within 2 minutes. This admix time was not acceptable for most electrophotographic applications due to the long time required for added toner to reach the charge of already charged toner. ,This Example illustrates that a single metal oxide layer consisting of a mixture of two hydrophobic silicas dispersed onto the toner surface does not give an acceptable admix performance, even if one of the hydrophobic silicas has a hydrophobic treatment that does not substantially react with the silica hydroxyl groups, as in R202™.

COMPARATIVE EXAMPLE VI

To 10 grams of the toner of Example I without the two layer additives were added 23 milligrams of hydrophobic silica, Degussa AEROSIL R812™ in a 120 milliliter bottle. The amount of silica used corresponds to approximately 25 percent of a monolayer coverage. The toner was roll milled with 100 grams of steel shot for 300 minutes at 96 feet/minute to bury the silica particles into the surface of the toner particle. To this mixture were added 23 milligrams more of hydrophobic silica, Degussa AEROSIL R812™. The total amount of silica used corresponds to approximately 50 percent of a monolayer coverage. The toner mixture was then roll milled a further 35 minutes at 96 feet/minute to disperse this silica onto the toner surface, on top of the buried silica layer. The toner charge and admix were determined by the substantially equivalent procedure of Comparative Example III, and the results are tabulated in Table 1. The admix time for this toner was within 8 minutes. This admix time was not acceptable for most electrophotographic applications due to the long time required for added toner to reach the charge of already charged toner. This Example illustrates that two layers of metal oxide, where both layers are comprised of hydrophobic silica, does not provide a fully acceptable admix performance.

COMPARATIVE EXAMPLE VII

To 10 grams of the toner of Example I without the two layers were added 23 milligrams of hydrophobic silica, Degussa AEROSIL R812™. The amount of silica used corresponds to approximately 25 percent of a monolayer coverage. The toner was roll milled with 100 grams of steel shot for 300 minutes at 96 feet/minute to bury the silica particles into the surface of the toner particle. To this mixture were added a further 47 milligrams more of hydrophobic silica, R202™. Although this metal oxide was hydrophobic, the hydrophobic treatment of this silica did not substantially react with the silica hydroxyl groups. The amount of silica used corresponds to approximately 25 percent of a monolayer coverage. The total amount of silica used corresponds to approximately 50 percent of a monolayer coverage. The toner mixture was then roll milled a further 35 minutes at 96 feet/minute to disperse the additive onto the toner surface, on top of the buried silica layer. The toner charge and admix were determined by the substantially equivalent procedure of Comparative Example III, and the results are tabulated in Table 1. The admix time for this toner was within 2 minutes. This admix time was not acceptable for most electrophotographic applications due to the long time required for added toner to reach the charge of already charged toner. This Comparative Example illustrates that two layers of metal oxide, where both layers are hydrophobic, does not give an acceptable admix performance, even if the second layer is comprised of a hydrophobic treated silica where the hydrophobic treatment does not substantially react with the silica hydroxyl groups.

EXAMPLE VIII

To 10 grams of the toner of Example I without the two surface additive layers were added 47 milligrams of hydrophobic silica, Degussa AEROSIL R202™. The amount of silica used corresponds to a approximately 25 percent of a monolayer coverage. The toner was roll milled with 100 grams of steel shot for 300 minutes at 96 feet/minute to bury the silica particles into the surface of the toner particle. To this mixture were added a further 23 milligrams of hydrophobic silica, Degussa AEROSIL R812™. Although this metal oxide was hydrophobic, it did not substantially react with the silica hydroxyl groups, as shown by infrared spectroscopy. The amount of silica used corresponds to approximately 25 percent of a monolayer coverage. The total amount of silica used corresponds to approximately 50 percent of a monolayer coverage. The toner mixture was then roll milled a further 35 minutes at 96 feet/minute to disperse the additive onto the toner surface, on top of the buried silica layer. The toner charge and admix were determined by the procedure of Comparative Example III, and the results are tabulated in Table 1. The admix time for this toner was within 1 minute. In this Example, each of the two metal oxide layers were hydrophobic, as in Comparative Example VI and Comparative Example VII where admix was not acceptable. However, in this Example, the hydrophobic metal oxide of the first layer, which was buried into the toner surface, was R202™, which was a hydrophobic treated silica that did not substantially react with the silica hydroxyl groups, as shown by infrared spectroscopy. In Comparative Examples VI and VII, where admix was not acceptable, the hydrophobic treated metal oxide R812™ did substantially react with the silica hydroxyl groups, as shown by infrared spectroscopy. This Example illustrates that two layers of metal oxide, where both layers are hydrophobic, provided an acceptable admix performance when the hydrophobic metal oxide of the first layer had a hydrophobic treatment that did not substantially react with the silica hydroxyl groups of the R202™.

COMPARATIVE EXAMPLE IX

To 10 grams of the toner of Example I without surface additive layers were added 35 milligrams of hydrophilic silica, Degussa AEROSIL A200™. The amount of silica used corresponds to approximately 25 percent of a monolayer coverage. The toner was roll milled with 100 grams of steel shot for 35 minutes at 96 feet/minute to disperse the silica particles onto the surface of the toner particle. The toner charge and admix were determined by the substantially equivalent procedure of Comparative Example III, and the results are tabulated in Table 1. The admix time for this toner was within 2 minutes. This admix time was not acceptable for electrophotographic applications, as new toner added to the developer was slow to reach the charge of already charged toner. This Comparative Example illustrates that a single layer of metal oxide, where said layer was comprised of a hydrophilic silica, did not provide a fully acceptable admix.

COMPARATIVE EXAMPLE X

To 10 grams of the toner of Example I without the two surface additive layers were added 47 milligrams of hydrophilic silica, Degussa AEROSIL A200™. The amount of silica used corresponds to approximately 25 percent of a monolayer coverage. The toner was roll milled with 100 grams of steel shot for 300 minutes at 96 feet/minute to bury the silica particles into the surface of the toner particle. To this mixture were added 23 milligrams of hydrophobic silica, Degussa AEROSIL R812™. The amount of silica used corresponds to approximately 25 percent of a monolayer coverage. The total amount of silica used corresponds to approximately 50 percent of a monolayer coverage. The toner mixture was then roll milled a further 35 minutes at 96 feet/minute to disperse the second additive onto the toner surface, on top of the buried additive layer. The toner charge and admix were determined by the substantially equivalent procedure of Comparative Example III, and the results are tabulated in Table 1. The admix time for this toner was within 2 minutes. This admix time was not acceptable for most electrophotographic applications, as new toner added to the developer was slow to reach the charge of already charged toner. This Comparative Example illustrates that a single layer of metal oxide, where said layer was comprised of both a hydrophilic and hydrophobic silica, did not provide fully acceptable admix performance.

COMPARATIVE EXAMPLE XI

To 10 grams of the toner of Example I without the two surface additive layers were added 23 milligrams of hydrophobic silica, Degussa AERO51L R812™. The toner was roll milled with 100 grams of steel shot for 300 minutes at 96 feet/minute to bury the silica particles into the surface of the toner particle. Scanning electron microscopy observation shows that there was little additive visible on the surface of the toner particles; the additive has been substantially embedded into the toner particle surface. To this mixture was added 47 milligrams of hydrophilic silica, Degussa AEROSIL A200™. The amount of silica used corresponds to a approximately 25 percent of a monolayer coverage. The total amount of silica used corresponds to approximately 50 percent of a monolayer coverage. The toner mixture was then roll milled a further 35 minutes at 96 feet/minute to disperse the second additive onto the toner surface, on top of the buried silica layer. Scanning electron microscopy observation shows the added silica particles are well dispersed onto the toner particle surface, and are clearly visible on the toner surface. The toner charge and admix were determined by the substantially equivalent procedure of Comparative Example III, and the results are tabulated in Table 1. The admix time for this toner was within 5 minutes. This admix time was not acceptable for most electrophotographic applications, as new toner added to the developer was slow to reach the charge of already charged toner. This Comparative Example illustrates that two layers of metal oxide, where the first layer was a hydrophobic silica, and the second layer was a hydrophilic silica, did not provide a fully acceptable admix performance.

EXAMPLE XII

To 10 grams of the toner of Example I without the two surface additive layers were added 47 milligrams of hydrophilic silica, Degussa AEROSIL A200™. The amount of silica used corresponds to approximately 25 percent of a monolayer coverage. The toner was roll milled with 100 grams of steel shot for 300 minutes at 96 feet/minute to disperse the silica particles onto the surface of the toner particle. To this mixture were added 47 milligrams of hydrophilic silica, Degussa AEROSIL A200™. The amount of silica used corresponds to approximately 25 percent of a monolayer coverage. The total amount of silica used corresponds to approximately 50 percent of a monolayer coverage. The resulting toner mixture was then roll milled a further 35 minutes at 96 feet/minute to disperse the second additive onto the toner surface, on top of the buried additive layer. The toner charge and admix were determined by the same procedure of Comparative Example III, and the results are tabulated in Table 1. The admix time for this toner was within 1 minute. This admix time was more acceptable for many electrophotographic applications, as new toner added to the developer rapidly reached the charge of already charged toner. This Example illustrates that two layers of metal oxide, where both layers were comprised of hydrophilic silica, provided an acceptable admix performance.

EXAMPLE XIII

To 10 grams of the toner of Example I without the two surface additive layers were added 47 milligrams of hydrophilic silica, Degussa AEROSIL A200™. The amount of silica used corresponds to approximately 25 percent of a monolayer coverage. The toner was roll milled with 100 grams of steel shot for 300 minutes at 96 feet/minute to bury the silica particles into the surface of the toner particle. To this mixture were added 23 milligrams of hydrophobic silica, Degussa AEROSIL R812™. The amount of silica used corresponds to approximately 25 percent of a monolayer coverage. The total amount of silica used corresponds to approximately 50 percent of a monolayer coverage. The toner mixture was then roll milled a further 300 minutes at 96 feet/minute to disperse the second additive onto the toner surface, on top of the buried layer. The toner charge and admix were determined by the substantially equivalent procedure of Comparative Example III, and the results are tabulated in Table 1. The admix time for this toner was within 0.5 minute. This admix time was very acceptable for most electrophotographic applications, as new toner added to the developer rapidly reached the charge of already charged toner. This Example illustrates that two layers of metal oxide, where the first layer was comprised of hydrophilic silica, and the second layer was: comprised of a hydrophobic silica, provides an acceptable admix performance.

EXAMPLE XIV

To 10 grams of the toner of Example I without the two surface additive layers were added 130 milligrams of hydrophilic titania, Degussa AEROSIL P25™. The amount of titania used corresponds to approximately 25 percent of a monolayer coverage. The toner was roll milled with 100 grams of steel shot for 300 minutes at 96 feet/minute to bury the titania particles into the surface of the toner particle. To this mixture were added 23 milligrams of hydrophobic silica, Degussa AEROSIL R812™. The amount of silica used corresponds to approximately 25 percent of a monolayer coverage. The total amount of silica used corresponds to approximately 50 percent of a monolayer coverage. The toner mixture was then roll milled a further 300 minutes at 96 feet/minute to disperse the silica additive onto the toner surface, on top of the buried titania layer. The toner charge and admix were determined by the same procedure of Comparative Example III, and the results are tabulated in Table 1. The admix time, as determined by a charge spectrograph throughout, for this toner was within 0.75 minute. This admix time was excellent for substantially all electrophotographic, especially xerographic imaging methods, or applications, as new toner added to the developer rapidly attained the charge of already charged toner. This Example illustrates that two layers of metal oxide, where the first buried layer was comprised of hydrophilic titania, and the second layer was comprised of a hydrophobic silica, provides an acceptable admix performance.

TABLE 1

Toner Charge and Admix with Mixtures of Hydrophobic and Hydrophilic Metal Oxide Additives

| | TONER ADDITIVES | | | | | | | |
|---|---|---|---|---|---|---|---|---|
| | FIRST LAYER | | | | Second Layer (35 minutes blending with 25% coverage of additive) | | Admix | Q/M |
| | Type | Hydrophobic | Coverage (%) | Blend Time (min) | Type | Hydrophobic | 20% RH | 20% RH |
| Comparative Example III | none | | | | none | | <15 | −16 |
| Comparative Example IV | R812 | yes | 50 | 35 | none | | 4 | −25 |
| Comparative Example V | R202 | yes | 50 | 35 | none | | 2 | −33 |
| | R812 | yes | | 35 | | | | |
| Comparative Example VI | R812 | yes | 25 | 300 | R812 | yes | 8 | −31 |
| Comparative Example VII | R812 | yes | 25 | 300 | R202 | yes | 4 | −22 |
| Example VIII | R202 | yes | 25 | 300 | R812 | yes | 1 | −27 |
| Comparative Example IX | A200 | no | 50 | 35 | none | | 2 | −29 |
| Comparative Example X | A200 | no | 25 | 35 | none | | 2 | −31 |

TABLE 1-continued

Toner Charge and Admix with Mixtures of Hydrophobic and Hydrophilic Metal Oxide Additives

| | TONER ADDITIVES | | | | | | | |
|---|---|---|---|---|---|---|---|---|
| | FIRST LAYER | | | | Second Layer (35 minutes blending with 25% coverage of additive) | | Admix | Q/M |
| | Type | Hydrophobic | Coverage (%) | Blend Time (min) | Type | Hydrophobic | 20% RH | 20% RH |
| | R812 | yes | 25 | | | | | |
| Comparative Example XI | R812 | yes | 25 | 300 | A200 | no | 5 | −17 |
| Example XII | A200 | no | 25 | 300 | A200 | no | 1 | −26 |
| Example XIII | A200 | no | 25 | 300 | R812 | yes | 0.5 | −20 |
| Example XIV | P25 | no | 25 | 300 | R812 | yes | 0.75 | −21 |

Q/M = Tribo Toner Charge
RH = Relative Humidity

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and optional charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of said aggregates in the coalescence step (v);

(v) heating and coalescing from about 5° to about 50° C. above about the resin glass transition temperature, Tg, which resin Tg is from between about 45° C. to about 90° C., said aggregates to form said toner comprised of resin, pigment and optional charge control agent;

(vi) washing the said aggregates at a temperature of from about 15° C. to about 5° C. below the glass transition temperature of the resin, and subsequently filtering the said aggregates until substantially all of the surfactant has been removed from the said aggregates, followed by subsequent drying of said aggregates at a temperature of from about 15° C. to about 5° C. below the glass transition temperature of the resin; and (vii) subsequently adding to said toner product a first layer of a hydrophilic oxide, and a second layer of a hydrophobic oxide.

2. A process in accordance with claim 1 wherein the first hydrophilic oxide layer is of a thickness of from about one to two times the thickness of the diameter of said oxide wherein said thickness is from about 5 to about 100 nanometers, and wherein said oxide layer is substantially incorporated into the toner such that the top of the oxide layer is substantially contiguous with the toner surface.

3. A process in accordance with claim 1 wherein the second hydrophilic metal oxide layer is dispersed onto the toner surface and is present over the first metal oxide layer, and wherein said second layer is not significantly incorporated into the toner surface.

4. A process in accordance with claim 1 wherein the first layer is comprised of a metal oxide with hydroxy groups.

5. A process in accordance with claim 1 wherein the second layer is comprised of a metal oxide with hydroxyl groups, and wherein said layer is of a thickness of from about 5 to about 100 nanometers, and wherein said layer covers from about 20 to about 100 percent of the toner surface.

6. A process in accordance with claim 1 wherein the second layer is comprised of a metal oxide free of hydroxyl groups.

7. A process in accordance with claim 1 wherein the first and second layers are added by mixing the first oxide with a mixing device at a temperature of from about 20° C. to about 5° C. below the toner glass transition temperature (Tg) for from about 10 seconds to about 24 hours to substantially bury, or incorporate the oxide within the toner, followed by subsequently mixing the second oxide with the toner by mixing at a temperature of from about 20° C. to about 5° C. below the toner Tg for from about 5 seconds to about 12 hours to disperse the metal oxide on the toner surface.

8. A process in accordance with claim 1 wherein the toner possesses an admix of from about 30 seconds to about 60 seconds.

9. A process in accordance with claim 1 wherein the second oxide layer is a metal oxide comprised of a hydrophobic metal oxide.

10. A process in accordance with claim 1 wherein the second oxide layer is a metal oxide comprised of a hydrophilic metal oxide.

11. A process in accordance with claim 1 wherein the first oxide layer is comprised of hydrophilic silica, and the second oxide layer is comprised of a hydrophobic silica.

12. A process in accordance with claim 1 wherein the first oxide layer is comprised of hydrophilic titania, and the second oxide layer is comprised of a hydrophobic silica.

13. A process in accordance with claim 1 wherein the first oxide layer is comprised of hydrophilic silica, and the second oxide layer is comprised of a hydrophobic titania.

14. A process in accordance with claim 1 wherein the first oxide layer is comprised of hydrophilic titania, and the second oxide layer is comprised of a hydrophobic titania.

15. A process in accordance with claim 1 wherein the first oxide layer is comprised of hydrophilic silica, and the second oxide layer is comprised of a hydrophilic silica.

16. A process in accordance with claim 1 wherein the surfactant utilized in preparing the pigment dispersion is a cationic surfactant in an amount of from about 0.01 percent to about 10 percent, and the counterionic surfactant present in the latex mixture is an anionic surfactant present in an amount of from about 0.2 percent to about 5 percent; and wherein the molar ratio of cationic surfactant introduced with the pigment dispersion to the anionic surfactant introduced with the latex can be varied from about 0.5 to about 5.

17. A process in accordance with claim 1 wherein the addition of further anionic surfactant (iv) further stabilizes the said aggregates and as a result fixes their size and particle size distribution as achieved in (iii), and wherein the particle size can be in the range of from about 3 to about 10 microns in average volume diameter, and the GSD is in the range of from about 1.16 to about 1.26.

18. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propyimethacrylate-butadiene), poly(butyimethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

19. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol; the anionic surfactant is selected from the group consisting of sodium dodecyl sulfate, sodium dodecylbenzene sulfate and sodium dodecylnaphthalene sulfate; and cationic surfactant is a quaternary ammonium salt.

20. A process in accordance with claim 1 wherein the anionic surfactant concentration is about 0.1 to about 5 weight percent of the aqueous phase of resin, pigment, optional charge control agent, and the cationic surfactant concentration is about 0.1 to about 5 weight percent of the aqueous phase of resin, pigment, and optional charge control agent.

21. A process in accordance with claim 1 wherein the thickness of the first layer of a hydrophilic metal oxide is from about 10 nanometers to about 200 nanometers, whereby the metal oxide occupies about 10 percent to about 80 percent of the volume of said layer, and the thickness of the second layer of a metal oxide is from about 10 nanometers to about 200 nanometers, whereby the metal oxide covers about 20 percent to about 100 percent of the area of the toner surface.

22. A process for the preparation of toner with controlled particle size consisting essentially of (i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and optional charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of said aggregates in the coalescence step (v);

(v) heating and coalescing from about 5° to about 50° C. above about the resin glass transition temperature, Tg, which resin Tg is from between about 45° C. to about 90° C., said aggregates to form said toner comprised of resin, pigment and optional charge control agent;

(vi) washing the said aggregates at a temperature of from about 15° C. to about 5° C. below the glass transition temperature of the resin, and subsequently filtering the said aggregates until substantially all of the surfactant has been removed from the said aggregates, followed by subsequent drying of said aggregates at a temperature of from about 15° C. to about 5° C. below the glass transition temperature of the resin; and (vii) subsequently adding to said toner product a first layer of a hydrophilic oxide substantially buried into the toner surface, and a second layer thereover said first layer of a hydrophobic or hydrophilic oxide.

23. A process in accordance with claim 1 wherein the resin Tg in (v) is from about 50° C. to about 80° C.

24. A process in accordance with claim 1 wherein said first and second layers of (vii) are comprised of a metal oxide.

25. A process in accordance with claim 1 wherein said first layer is hydrophobic and said second layer is hydrophilic.

* * * * *